US011919550B2

(12) United States Patent
Takewa et al.

(10) Patent No.: US 11,919,550 B2
(45) Date of Patent: Mar. 5, 2024

(54) RAIL BREAKAGE DETECTION DEVICE AND RAIL BREAKAGE RESULT MANAGEMENT SYSTEM

(71) Applicant: Mitsubishi Electric Corporation, Tokyo (JP)

(72) Inventors: Tomoaki Takewa, Tokyo (JP); Takafumi Nagano, Tokyo (JP); Yoshitsugu Sawa, Tokyo (JP); Wataru Tsujita, Tokyo (JP); Kenzo Makino, Tokyo (JP); Katsunori Tsuchida, Tokyo (JP); Daisuke Koshino, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 688 days.

(21) Appl. No.: 17/260,553

(22) PCT Filed: Jul. 26, 2018

(86) PCT No.: PCT/JP2018/028057
§ 371 (c)(1),
(2) Date: Jan. 15, 2021

(87) PCT Pub. No.: WO2020/021672
PCT Pub. Date: Jan. 30, 2020

(65) Prior Publication Data
US 2021/0269075 A1 Sep. 2, 2021

(51) Int. Cl.
*B61L 23/04* (2006.01)
*B61L 27/53* (2022.01)
*E01B 35/06* (2006.01)

(52) U.S. Cl.
CPC ..... *B61L 23/044* (2013.01); *B61L 27/53* (2022.01); *E01B 35/06* (2013.01)

(58) Field of Classification Search
CPC ..... B61L 23/044; B61L 27/53; E01B 35/06
(Continued)

(56) References Cited

U.S. PATENT DOCUMENTS 4,145,018 A * 3/1979 Poggio ..... B61L 23/044 246/34 R
9,682,716 B2 * 6/2017 Noffsinger ..... B61L 3/10
(Continued)

FOREIGN PATENT DOCUMENTS

CN 107985344 A 5/2018
JP 06-321110 A 11/1994
(Continued)

OTHER PUBLICATIONS

International Search Report and Written Opinion dated Aug. 28, 2018, received for PCT Application PCT/JP2018/028057, Filed on Jul. 26, 2018, 9 pages including English Translation.
(Continued)

*Primary Examiner* — Zachary L Kuhfuss
*Assistant Examiner* — James William Jones
(74) *Attorney, Agent, or Firm* — XSENSUS LLP

(57) ABSTRACT

A rail breakage detection device includes a first core part provided to a first cable connecting an electrical neutral point of an impedance bond that electrically connects a first rail and a second rail to the first rail, a second core part provided to a second cable connecting the electrical neutral point of the impedance bond to the second rail, a first coil wound around the first core part to generate a first electromotive force in accordance with a current variation occurring in the first cable, a second coil connected electrically to the first coil and wound around the second core part to generate a second electromotive force in accordance with a current variation occurring in the second cable, and a CPU to determine that the first or second rail is broken based on
(Continued)

an electromotive force that is a sum of the first and second electromotive forces.

10 Claims, 13 Drawing Sheets

(58) Field of Classification Search
USPC ..... 246/121
See application file for complete search history.

(56) References Cited

U.S. PATENT DOCUMENTS

| | | | | |
|---|---|---|---|---|
| 9,834,237 | B2 * | 12/2017 | Plotnikov | B61L 23/044 |
| 11,067,539 | B2 * | 7/2021 | Hay | B61L 23/044 |
| 2006/0118678 | A1 * | 6/2006 | Wells, II | B61L 23/00 246/121 |
| 2013/0284859 | A1 * | 10/2013 | Polivka | B61L 1/188 246/34 R |
| 2013/0334373 | A1 * | 12/2013 | Malone, Jr. | B61L 23/166 246/2 R |
| 2014/0012438 | A1 * | 1/2014 | Shoppa | B61L 27/53 701/19 |
| 2019/0047600 | A1 | 2/2019 | Asuka et al. | |

FOREIGN PATENT DOCUMENTS

| | | | | |
|---|---|---|---|---|
| JP | 2012-91671 | A | 5/2012 | |
| WO | WO-2014193610 | A1 * | 12/2014 | B61L 23/044 |
| WO | 2017/175277 | A1 | 10/2017 | |

OTHER PUBLICATIONS

Indian Office Action dated Jan. 5, 2022 in Indian Application No. 20212700294.

* cited by examiner

RAIL BREAKAGE DETECTION DEVICE AND RAIL BREAKAGE RESULT MANAGEMENT SYSTEM

CROSS-REFERENCE TO RELATED APPLICATION

The present application is based on PCT filing PCT/JP2018/028057, filed Jul. 26, 2018, the entire contents of which are incorporated herein by reference.

TECHNICAL FIELD

The present disclosure relates to a rail breakage detection device which detects breakage of railroad rails and a rail breakage result management system which uses the rail breakage detection device.

BACKGROUND TECHNOLOGY

Conventionally, the railroad rail breakage detection is made possible by a track circuit for train position detection. In recent years, introduction of a wireless train control system (communication-based train control: CBTC) which does not use the track circuit for train position detection is in progress; and thus, a rail breakage detection method which does not use the track circuit is required. One of the rail breakage detection methods which do not use the track circuit is a breakage detection method utilizing return current.

Current supplied from a substation to a rail car through an overhead line during the train travel is consumed by the rail car and then returns to the substation via the rails. The current returning to the substation through the rails is called return current. The return currents flow through a pair of rails in the same direction, meets at an electrical neutral point of an impedance bond installed at each of block sections of the rails, and then branches again and flows into the rails of the adjacent block section. If there is no abnormality such as rail breakage, the return currents flowing from the rail car to the pair of rails show balanced values. However, if one of the pair of rails is broken, the return current leaks into the ground at the broken rail side, so imbalance occurs in the return currents flowing through the pair of rails.

Patent Document 1 discloses a rail breakage detection method, a rail breakage detection device, and a rail breakage point detection method using the device, and describes a technology in which the return currents are measured on the rail car; the imbalance ratio of the return currents flowing through the pair of rails is calculated; and thus the breakage of the rails is detected.

In a rail breakage detection device disclosed in Patent Document 2, it is described that a first detection section L1 is set in one of the pair of rails and a second detection section L2 is set in the other, and that rail breakage is detected from the imbalance occurring between a first voltage drop signal V1 generated in the first detection section L1 by the return current and a second voltage drop signal V2 generated in the second detection section L2 by the return current.

PRIOR ART DOCUMENTS

Patent Documents

Patent Document 1: Japanese Unexamined Patent Application Publication No. HEI 6-321110

Patent Document 2: Japanese Unexamined Patent Application Publication No. 2012-91671

SUMMARY OF INVENTION

Problems to be Solved by Invention

In the rail breakage detection method, the rail breakage detection device, and the rail breakage point detection method using the device that are described in Patent Document 1, the return current is measured on the rail car based on a principle equivalent to that of the rail breakage detection method used in an automatic train control (ATC), etc. However, since the return current is a direct current or a low-frequency current, it is difficult to measure the return current accurately on the rail car. Also, since the resistance component of the rail is extremely small, it is necessary to lengthen the detection section in order to detect breakage of rails accurately using the rail breakage detection device described in Patent Document 2. However, if the detection section is made long, the configuration becomes complicated because it is necessary to lay down long conducting wires along the rails.

The present disclosure is made in order to solve the above problems and an object is to obtain a rail breakage detection device which can detect breakage of rails and a rail breakage result management system using the rail breakage detection device with a simple configuration.

Means for Solving the Problems

A rail breakage detection device according to the present disclosure comprises:

a first core part that is provided annularly along a circumferential direction of a first cable electrically connecting an electrical neutral point of an impedance bond to a prescribed block section of a first rail, the impedance bond electrically connecting the first rail and a second rail in a pair, a second core part that is provided annularly along a circumferential direction of a second cable electrically connecting the electrical neutral point of the impedance bond to the prescribed block section of the second rail, a first coil that is wound around the first core part to generate a first electromotive force in accordance with a current variation occurring in the first cable, and a second coil that is connected electrically to the first coil, is wound around the second core part to generate a second electromotive force in accordance with a current variation occurring in the second cable, and generates the second electromotive force so as to cancel the first electromotive force out when the current variation occurring in the second cable is identical with the current variation occurring in the first cable in terms of a direction and a magnitude; and a CPU configured to determine that the first rail or the second rail is broken based on an electromotive force being a sum of the first electromotive force and the second electromotive force.

A rail breakage detection device according to the present disclosure comprises:

a first core part that is provided annularly along a circumferential direction of a first cable electrically connecting an electrical neutral point of an impedance bond to a prescribed block section of the first rail, and made of a magnetic material to generate a first magnetic flux in accordance with return current flowing through the first cable, the impedance bond electrically connecting a first rail and a second rail in a pair, a second core part that is provided annularly along a circumferential direction of a second cable electrically connecting the electrical neutral point of the impedance bond to the prescribed block section of the second rail, is mechanically connected to the first core part, generates a second magnetic flux in accordance with return current flowing through the second cable, and is made of a magnetic material to generate the second magnetic flux so as to cancel the first magnetic flux out when the return current flowing through the second cable is identical with the return current flowing through the first cable in terms of a direction and a magnitude, and a Hall element that is disposed in a gap provided in either the first core part or the second core part to generate an electromotive force in accordance with a sum of the first magnetic flux and the second magnetic flux; and a CPU configured to determine that the first rail or the second rail is broken based on the electromotive force generated by the Hall element.

A rail breakage result management system according to the present disclosure includes:

the rail breakage detection device described above; and a management server to store a breakage detection result of rails detected by the rail breakage detection device and a management number in association with each other, the management number being assigned individually to a block section of rails, wherein the rail breakage detection device includes an information output unit to output the breakage detection result of the rails and the management number to the management server via a network.

Effects of Invention

The rail breakage detection device according to the present disclosure makes it possible to detect breakage of rails with a simple configuration.

The rail breakage result management system according to the present disclosure makes it possible to detect breakage of rails with a simple configuration.

EMBODIMENTS FOR CARRYING OUT THE INVENTION

Hereinafter, referring to the attached drawings, embodiments of the rail breakage detection device disclosed in the present application will be described in detail. Note that the following embodiments are just examples, and the present disclosure is not limited by these embodiments.

Embodiment 1

Figure 1:
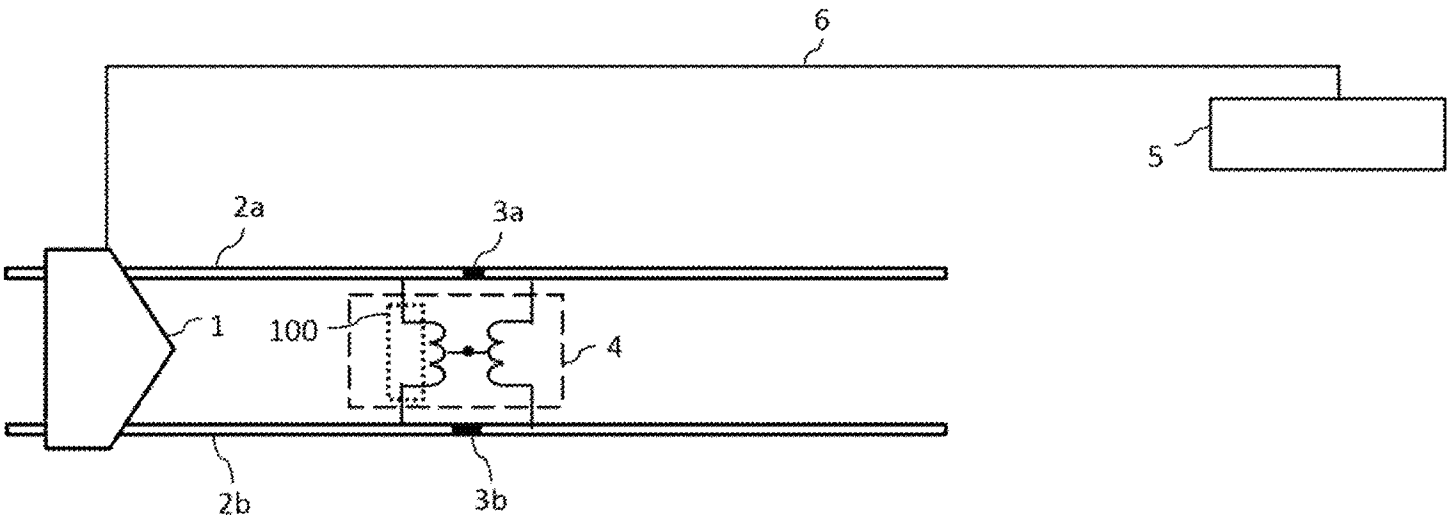
FIG. 1 is a diagram showing a configuration around a rail breakage detection device according to Embodiment 1 of the present disclosure.

FIG. 1 is a diagram showing a configuration of a rail breakage detection device 100 and its surroundings according to Embodiment 1 of the present disclosure. FIG. 1 shows a train 1, a first rail 2*a* and a second rail 2*b* that are a pair, rail insulating members 3*a* and 3*b* respectively provided on the first rail 2*a* and the second rail 2*b*, an impedance bond 4 that electrically connects the first rail 2*a* and the second rail 2*b*, a rail breakage detection device 100 attached to the impedance bond 4 for detecting breakage of the first rail 2*a* or the second rail 2*b*, a substation 5, and an overhead line 6. The impedance bond 4 is installed at a location where the first rail 2*a* and the second rail 2*b* are insulated from an adjacent block section by the rail insulating members 3*a* and 3*b*, and is a device which allows only return current to flow into the adjacent block section without passing signal current used for train control.

Figure 2:
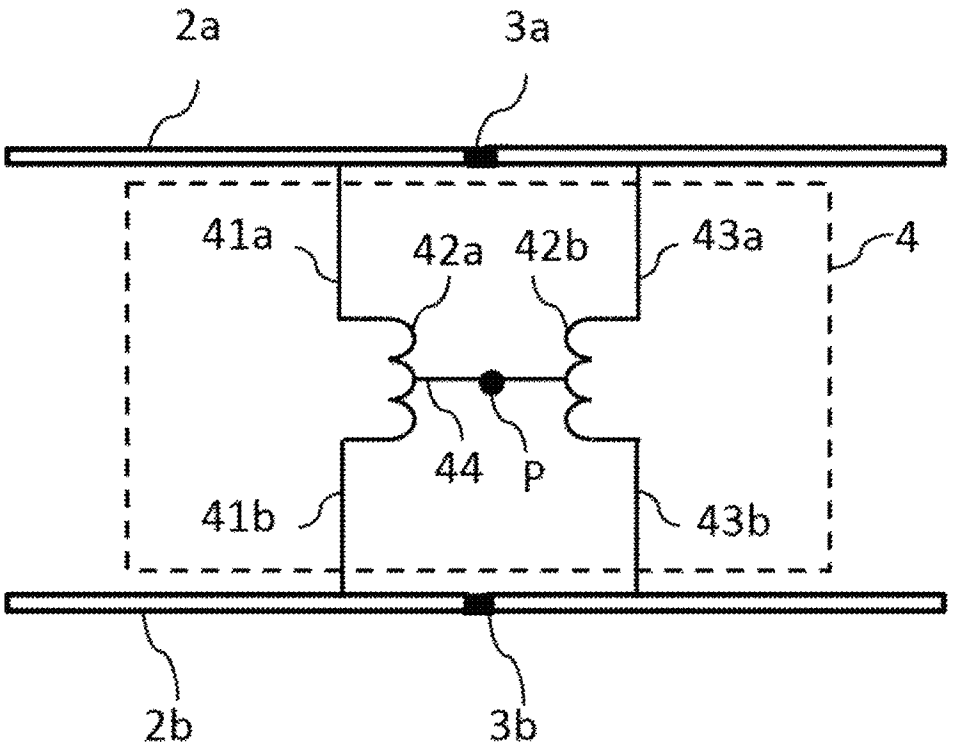
FIG. 2 is a diagram showing an example of a configuration of an impedance bond attached to the rails.

FIG. 2 is a diagram showing a configuration of the impedance bond 4 electrically connecting the first rail 2*a* and the second rail 2*b*. A first winding 42*a* of the impedance bond 4 is connected to the first rail 2*a* by a first cable 41*a* and to the second rail 2*b* by a second cable 41*b*. The first rail 2*a* to which the first cable 41*a* is connected and the second rail 2*b* to which the second cable 41*b* is connected are a pair of rails in the same block section. A second winding 42*b* is connected to the first rail 2*a* by a third cable 43*a* and to the second rail 2*b* by a fourth cable 43*b*. The first rail 2*a* to which the third cable 43*a* is connected and the second rail 2*b* to which the fourth cable 43*b* is connected are a pair of rails in the same block section. The first winding 42*a* and the second winding 42*b* are electrically connected by a fifth cable 44. The fifth cable 44 has an electrical neutral point P.

Figure 3:
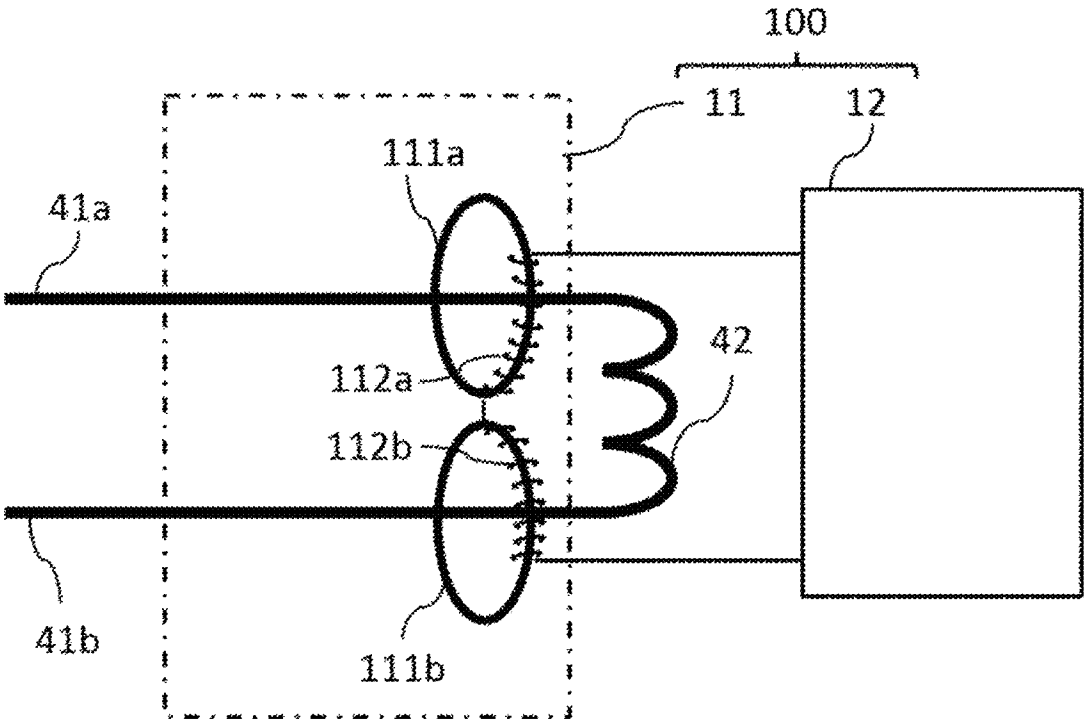
FIG. 3 is a diagram showing an example of a configuration of the rail breakage detection device according to Embodiment 1 of the present disclosure.

FIG. 3 is a diagram showing an example of a configuration of the rail breakage detection device 100 which detects breakage of the first rail 2*a* or the second rail 2*b*. As shown in FIG. 3, the rail breakage detection device 100 includes an electromotive force generating unit 11 which generates an electromotive force in accordance with the current variations caused by the return currents in the first cable 41*a* and the second cable 41*b*, and a breakage determination unit 12 which performs breakage determination of the first rail 2*a* to which the first cable 41*a* is connected or the second rail 2*b* to which the second cable 41*b* is connected, on the basis of the electromotive force generated by the electromotive force generating unit 11.

In FIG. 3, an example of a configuration in which the electromotive force generating unit 11 is attached to the first cable 41*a* and the second cable 41*b* is shown. However, rail breakage can be detected even with a configuration in which the electromotive force generating unit 11 is attached to the third cable 43*a* and the fourth cable 43*b*. When the electromotive force generating unit 11 is attached to the third cable 43*a* and the fourth cable 43*b*, the electromotive force generating unit 11 generates the electromotive force in accordance with the current variations occurring in the third cable 43*a* and the fourth cable 43*b*. The breakage determination unit 12 determines whether breakage has occurred in the first rail 2*a* to which the third cable 43*a* is connected or the second rail 2*b* to which the fourth cable 43*b* is connected, on the basis of the electromotive force generated by the electromotive force generating unit 11.

Regarding in which block section the rail breakage detection device 100 is to be installed to determine the breakage of the rail, it is decided before or at the time when the rail breakage detection device 100 is installed. In the following description, a case where the electromotive force generating unit 11 is attached to the first cable 41*a* and the second cable 41*b* will be described.

The rail breakage detection device 100 according to Embodiment 1 is configured to perform breakage determination by using the breakage determination unit 12 to detect breakage of the first rail 2*a* or the second rail 2*b* when an electromotive force is generated in the electromotive force generating unit 11. A detailed configuration of the rail breakage detection device 100 will be described later.

Typically, the return currents flowing through the first rail 2*a* and the second rail 2*b* show different values every time. Therefore, when measuring the return currents and detecting breakage of the first rail 2*a* or the second rail 2*b*, it is necessary to measure the current values of the return currents every time they flow and to detect breakage using a threshold in accordance with the current values measured.

In contrast, in the rail breakage detection device 100 according to Embodiment 1, the electromotive force generating unit 11 is configured not to generate the electromotive force when current variations of the same magnitude and direction occur in the first cable 41*a* and the second cable 41*b* by the return currents. In other words, the configuration is such that the electromotive force generating unit 11 generates the electromotive force in a case where imbalance occurs in the current variations of the first cable 41*a* and the second cable 41*b* caused by imbalance that occurs in the return currents flowing through the first rail 2*a* and the second rail 2*b* when the first rail 2*a* or the second rail 2*b* is broken.

Therefore, regardless of the magnitude of the return current, the rail breakage detection device 100 according to Embodiment 1 can detect breakage of the first rail 2*a* or the second rail 2*b* when the electromotive force generating unit 11 generates the electromotive force. Further, since it is not necessary to measure the current values of the return current, the rail breakage detection device 100 according to Embodiment 1 can detect rail breakage with a simple configuration.

Next, detailed configurations of the electromotive force generating unit 11 and the breakage determination unit 12 of the rail breakage detection device 100 will be described.

The electromotive force generating unit 11 includes a first core part 111*a* annularly provided in the circumferential direction of the first cable 41*a*, a second core part 111*b* annularly provided in the circumferential direction of the second cable 41*b*, a first coil 112*a* which is wound around the first core part 111*a* and generates a first electromotive force in accordance with the current variation that occurs in the first cable 41*a*, and a second coil 112*b* which is wound around the second core part 111*b* and generates a second electromotive force in accordance with the current variation that occurs in the second cable 41*b*. The shapes of the first core part 111*a* and the second core part 111*b* is not limited to an annular shape and, for example, may be a polygonal shape such as a triangular shape or a square shape, or an oval shape.

The first core part 111*a* and the second core part 111*b* are made of a magnetic material. By the first core part 111*a* and the second core part 111*b* made of a magnetic material, a magnetic flux generated in accordance with the current variation that occurs in the first cable 41*a* can be prevented from leaking outside the first core part 111*a*, and a magnetic flux generated in accordance with the current variation that occurs in the second cable 41*b* can be prevented from leaking outside the second core part 111*b*. Therefore, the positions where the first coil 112*a* and the second coil 112*b* are provided can be changed accordingly, and as a result, the configuration of the rail breakage detection device 100 can be simplified.

Note that the first core part 111*a* and the second core part 111*b* are not necessarily made of a magnetic material, and for example, they may be made of a non-magnetic material such as plastic. However, when the first core part 111*a* and the second core part 111*b* are made of a non-magnetic material, it is necessary to place the first coil 112*a* at a position where the first coil 112*a* does not generate an electromotive force due to the current variation that occurs in the second cable 41*b*, and to place the second coil 112*b* at a position where the second coil 112*b* does not generate an electromotive force due to the current variation that occurs in the first cable 41*a*.

The first coil 112*a* and the second coil 112*b* are electrically connected. Also, the first coil 112*a* and the second coil 112*b* are respectively wound around the first core part 111*a* and the second core part 111*b* such that the first electromotive force generated by the first coil 112*a* and the second electromotive force generated by the second coil 112*b* cancel each other out when current variations of the same magnitude and direction occur in the first cable 41*a* and the second cable 41*b*. Here, the current variations in the same direction means a case in which both the current flowing from the first rail 2*a* to the electrical neutral point P of the impedance bond 4 via the first cable 41*a* and the current flowing from the second rail 2*b* to the electrical neutral point P of the impedance bond 4 via the second cable 41*b* increase or decrease, or a case in which both the current flowing from the electrical neutral point P of the impedance bond 4 to the first rail 2*a* via the first cable 41*a* and the current flowing from the electrical neutral point P of the impedance bond 4 to the second rail 2*b* via the second cable 41*b* increase or decrease. Further, the electromotive forces opposite to each other in the direction means that the first electromotive force generated between both ends of the first coil 112*a* and the second electromotive force generated between both ends of the second coil 112*b* are in the direction in which their forces are cancelled out with each other.

The electromotive forces generated in the first coil 112*a* and the second coil 112*b* are represented by Equation (1). Note that i in Equation (1) takes 1 or 2. To be specific, when i=1, in Equation (1), $V_1$ is the first electromotive force, $N_1$ is the number of turns of the first coil 112*a*, $\Phi_1$ is a magnetic flux density generated in the first core part 111*a*, $\mu_1$ is a magnetic permeability of the first core part 111*a*, and $H_1$ is a magnetic flux generated in the first core part 111*a*. When i=2, in Equation (1), $V_2$ is the second electromotive force, $N_2$ is the number of turns of the second coil 112*b*, $\Phi_2$ is a magnetic flux density generated in the second core part 111*b*, $\mu_2$ is a magnetic permeability of the second core part 111*b*, and $H_2$ is a magnetic flux generated in the second core part 111*b*.

$$V_1 = -N_1 \cdot \frac{d\Phi_i}{dt} = -\mu_i N_i \cdot \frac{f_s dH_i \cdot dS}{dt} \quad (1)$$

In order to have a configuration in which the electromotive force generating unit 11 will not generate the electromotive force when the current variations of the same magnitude and direction occur in the first cable 41*a* and the second cable 41*b*, $V_1$ (the first electromotive force) and $V_2$ (the second electromotive force) need to be equal in magnitude and opposite in direction. That is, $V_1=-V_2$ needs to be held. For example, if $V_1$ (the first electromotive force) and $V_2$ (the second electromotive force) are equal in magnitude and opposite in direction ($V_1=-V_2$) and the first core part 111*a* and the second core part 111*b* are made of the same material and the first coil 112*a* and the second coil 112*b* are made of the same material, $N_1=-N_2$ holds from Equation (1), so that the winding directions of the first coil 112*a* and the second coil 112*b* are opposite to each other and the numbers of turns of the first coil 112*a* and the second coil 112*b* are the same.

In other words, the material and shape of the first core part 111*a*, the material, shape, and the number of turns of the first coil 112*a*, the material and shape of the second core part 111*b*, and the material, shape, and the number of turns of the second coil 112*b* need to be configured such that Equation (1) satisfies V1=−V2 when the current variations of the same magnitude and direction occur in the first cable 41*a* and the second cable 41*b*.

The breakage determination unit 12 is connected electrically to the first coil 112*a* and the second coil 112*b* and measures the electromotive force generated by the electromotive force generating unit 11. When the electromotive force generated by the electromotive force generating unit 11 is greater than or equal to a threshold, the breakage determination unit 12 performs breakage determination of the first rail 2*a* or the second rail 2*b*. The threshold is determined, for example, by measuring in advance values of the electromotive force generated by the electromotive force generating unit 11 when the train 1 travels with the first rail 2*a* and the second rail 2*b* unbroken, and by calculating an average and a standard deviation of the electromotive force. Specifically, the threshold is determined on the basis of Equation (2). Here, Vh is a threshold value, V0 is an average of the electromotive force, σ is a standard deviation thereof, and a is a value determined in accordance with the required accuracy of the rail breakage detection.

$$Vh=V0+\alpha\sigma \quad (2)$$

Figure 4:
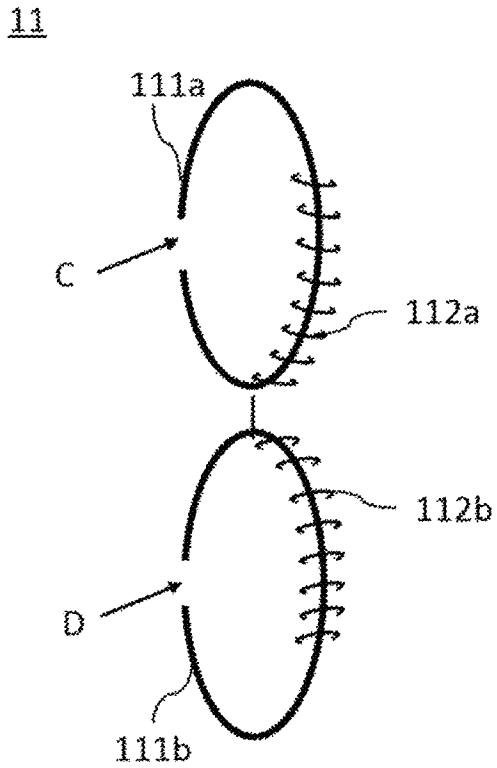
FIG. 4 is a diagram showing a variation of an electromotive force generating unit of the rail breakage detection device according to Embodiment 1 of the present disclosure.

FIG. 4 shows a variation of the electromotive force generating unit 11. The first core part 111*a* and the second core part 111*b* do not necessarily have a loop shape and may have a structure having a gap C and a gap D, respectively, as shown in FIG. 4. By providing the gap C and the gap D to the first core part 111*a* and the second core part 111*b*, respectively, it becomes easy to attach the first core part 111*a* and the second core part 111*b* to the first cable 41*a* and the second cable 41*b*, respectively.

Figure 5:
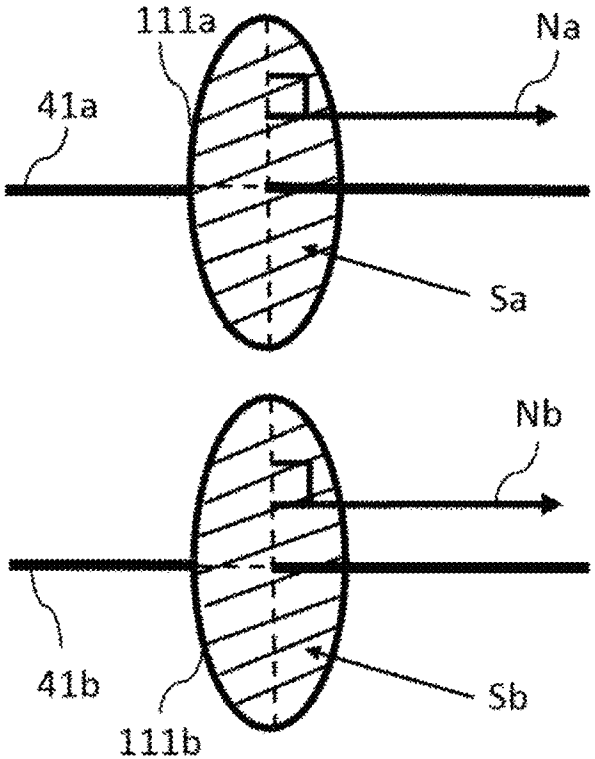
FIG. 5 is a diagram showing an example of a positional relationship of the first cable and the second cable with the first core part and the second core part of the rail breakage detection device according to Embodiment 1 of the present disclosure.

FIG. 5 is a diagram showing a positional relationship of the first cable 41*a* and the second cable 41*b* with the first core part 111*a* and the second core part 111*b*. In FIG. 5, a normal vector Na is the normal vector of the opening plane Sa formed inside the first core part 111*a*, and a normal vector Nb is the normal vector of the opening plane Sb formed inside the second core part 111*b*. As shown in FIG. 5, the first cable 41*a* is provided in parallel with the normal vector Na, and the second cable 41*b* is provided in parallel with the normal vector Nb. That is, FIG. 5 shows that the direction of the normal vector Na and the direction of the current flowing through the first cable 41*a* are parallel, and the direction of the normal vector Nb and the direction of the current flowing through the second cable 41*b* are parallel.

The magnitude of the magnetic flux that is generated in each of the first core part 111*a* and the second core part 111*b* by the currents respectively flowing through the first cable 41*a* and the second cable 41*b* is determined according to Ampere's law. That is, when the direction of the normal vector Na and the direction of the current flowing through the first cable 41*a* are made parallel and the direction of the normal vector Nb and the direction of the current flowing through the second cable 41*b* are made parallel, the magnetic flux generated in each of the first core part 111*a* and the second core part 111*b* becomes the largest. As a result, the electromotive forces generated by the electromotive force generating unit 11 in accordance with the current variations occurring in the first cable 41*a* and the second cable 41*b* increase. Therefore, by providing the first cable 41*a* in parallel with the normal vector Na and the second cable 41*b* in parallel with the normal vector Nb, it is possible to accurately detect the current variations occurring in the first cable 41*a* and the second cable 41*b*.

Figure 6:
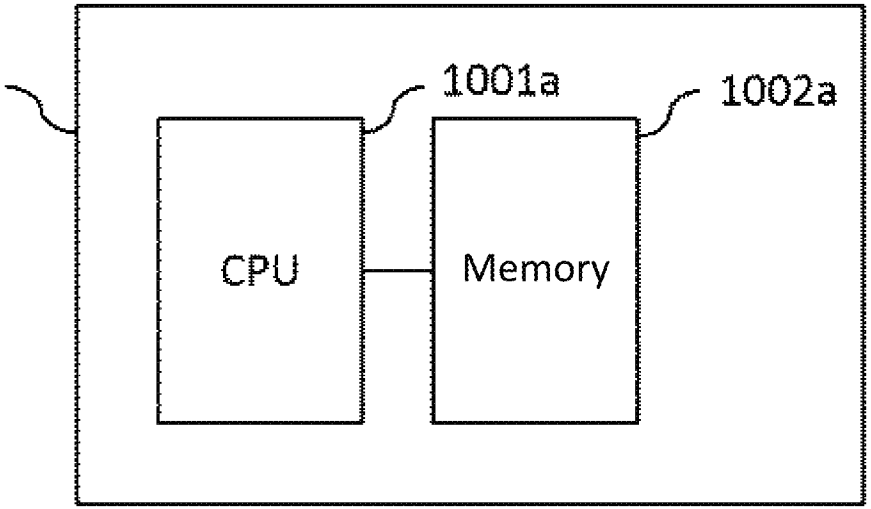
FIG. 6 is a diagram showing an example of a configuration of a breakage determination unit of the rail breakage detection device according to Embodiment 1 of the present disclosure.

FIG. 6 is a diagram showing a configuration of the breakage determination unit 12. The breakage determination unit 12 can be implemented by software control by a CPU 1001*a* executing a program stored in a memory 1002*a*, as shown in FIG. 6. Further, the breakage determination unit 12 may be configured such that, when the first rail 2*a* or the second rail 2*b* is broken and the electromotive force generated by the electromotive force generating unit 11 is greater than or equal to a predetermined threshold, the generated electromotive force is used as a power source for operation of the breakage determination unit 12. In a case where a configuration is made such that the electromotive force generated by the electromotive force generating unit 11 is used as the power source, the breakage determination unit 12 can perform the breakage determination of the first rail 2*a* or the second rail 2*b* without using an external power supply.

Next, how the return current flows will be described separately for a case where neither the first rail 2*a* nor the second rail 2*b* is broken as compared to a case where the first rail 2*a* or the second rail 2*b* is broken.

Figure 7:
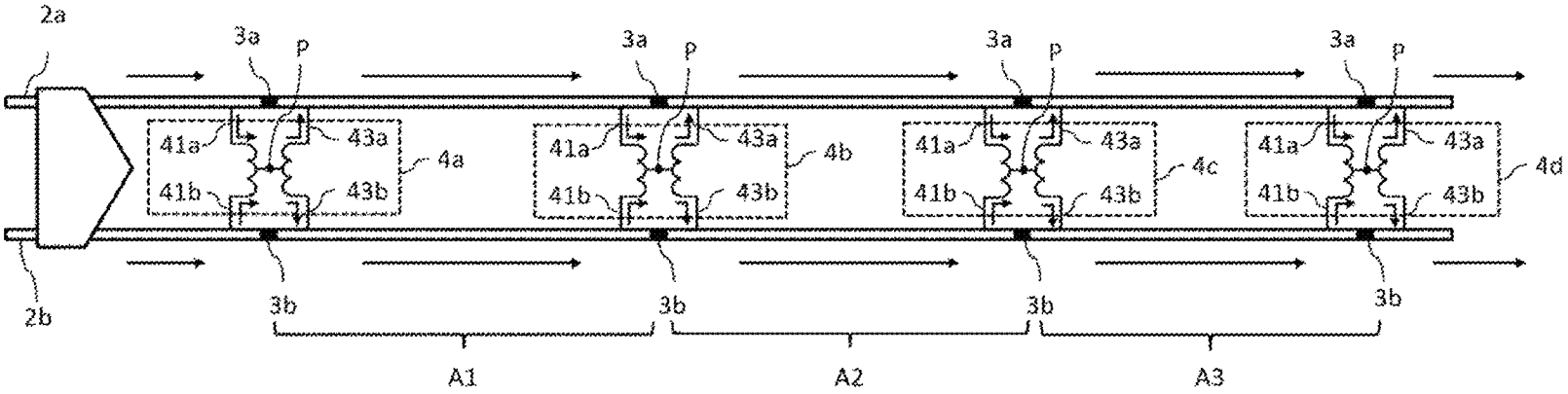
FIG. 7 is a diagram showing how return current flows when the rails are not broken.

FIG. 7 is a diagram showing how the return current flows when neither the first rail 2*a* nor the second rail 2*b* is broken. In FIG. 7, the arrows indicate the direction in which the return current flows, and A1, A2, and A3 each indicate the block section sectioned by the rail insulating members 3*a* and 3*b*. In FIG. 7, the electromotive force generating unit 11 of the rail breakage detection device 100 is provided for the first cable 41*a* and the second cable 41*b* in each of the impedance bonds 4*a*, 4*b*, 4*c*, and 4*d*. However, the illustration is omitted in FIG. 7.

If neither the first rail 2*a* nor the second rail 2*b* is broken, the return currents flowing through the first rail 2*a* and the second rail 2*b* of the block section A1 pass through the first cable 41*a* and the second cable 41*b* of the impedance bond 4*b*, meet at the electrical neutral point P of the impedance bond 4*b*, pass through the third cable 43*a* and the fourth cable 43*b* of the impedance bond 4*b*, and flow into the first rail 2*a* and the second rail 2*b* of the adjacent block section A2. The return current flows in the same manner when flowing from the block section A2 to the block section A3.

As shown in FIG. 7, when neither the first rail 2*a* nor the second rail 2*b* is broken, the magnitudes of the return currents flowing through the first rail 2*a* and the second rail 2*b* are equal in each of the block sections, so that the current variations occurring in the first cable 41*a* and the second cable 41*b* in each of the block sections are balanced. Also, the current variations occurring in the third cable 43*a* and the fourth cable 43*b* in each block section are balanced.

Figure 8:
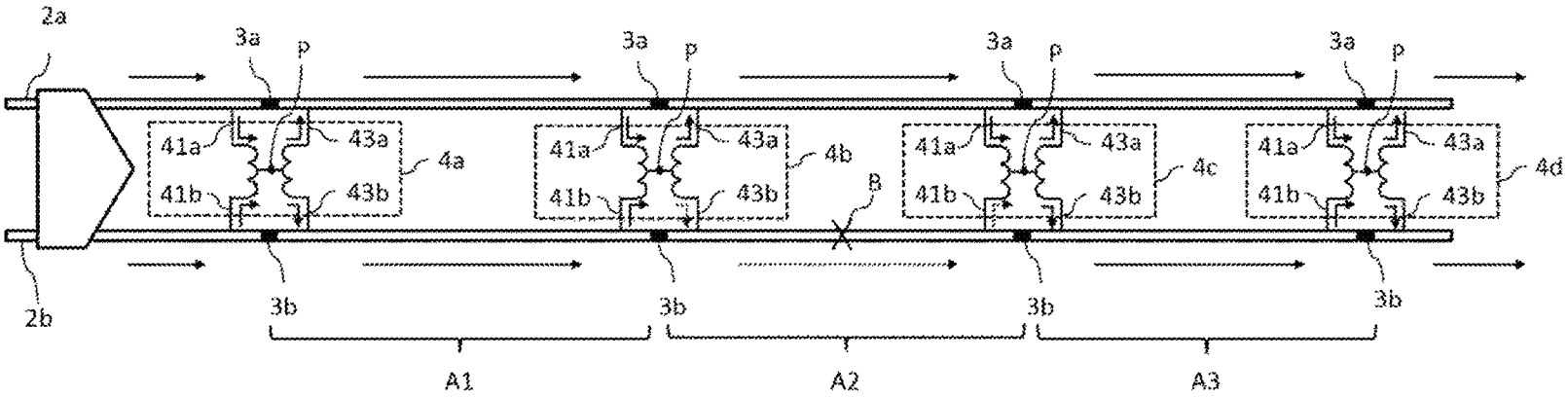
FIG. 8 is a diagram showing how the return current flows when a rail is broken.

Next, how the return current flows when the second rail 2*b* is broken will be described. FIG. 8 is a diagram showing how the return current flows when a breakage B in the second rail 2*b* occurs. In FIG. 8, the arrows indicate the direction in which the return current flows, and A1, A2, and A3 each indicate the block section sectioned by the rail insulating members 3*a* and 3*b*. In FIG. 8, the electromotive force generating unit 11 of the rail breakage detection device 100 is provided for the first cable 41*a* and the second cable 41*b* in each of the impedance bonds 4*a*, 4*b*, 4*c*, and 4*d*. However, the illustration is omitted in FIG. 8.

Since no breakage occurs in the first rail 2*a* and the second rail 2*b* in the block section A1, the current variations occurring in the first cable 41*a* and the second cable 41*b* of the impedance bond 4*b* are balanced. Also, the current variations occurring in the third cable 43*a* and the fourth cable 43*b* of the impedance bond 4*a* are balanced.

However, in the block section A2, the breakage B occurs in the second rail 2*b*, so that only leakage current based on a leakage impedance component between the second rail 2*b* and the ground flows through the second rail 2*b* in the block section A2. Generally, in a railroad, since the leakage impedance is set to be large, the return current flowing through the second rail 2*b* of the block section A2 is small. Therefore, imbalance occurs in the return currents flowing through the first rail 2*a* and the second rail 2*b* of the block section A2, so that the current variations occurring in the first cable 41*a* and the second cable 41*b* of the impedance bond 4*c* are imbalanced. In addition, with the breakage B occurring in the second rail 2*b* of the block section A2, the current variations occurring in the third cable 43*a* and the fourth cable 43*b* of the impedance bond 4*b* are also imbalanced.

Due to the breakage B, the return currents flowing through the first cable 41*a* and the second cable 41*b* of the impedance bond 4*c* become imbalanced. Even so, the return currents flowing through the first cable 41*a* and the second cable 41*b* of the impedance bond 4*c* meet at the electrical neutral point P of the impedance bond 4*c*, pass through the third cable 43*a* and the fourth cable 43*b* of the impedance bond 4*c*, and flow into the first rail 2*a* and the second rail 2*b* of the adjacent block section A3. Since no breakage occurs in the first rail 2*a* and the second rail 2*b* of the block section A3, the current variations occurring in the third cable 43*a* and the fourth cable 43*b* of the impedance bond 4*c* are balanced, and the return currents flowing through the first rail 2*a* and the second rail 2*b* of the block section A3 are balanced.

Therefore, as shown in FIG. 8, even when the breakage B occurs in the block section A2, the return currents flowing through the first rail 2*a* and the second rail 2*b* of the block section A1 and block section A3 that are adjacent are balanced, and the current variations occurring in the first cable 41*a* and the second cable 41*b* of each of the impedance bonds 4*b* and 4*d* are balanced. Also, the current variations occurring in the third cable 43*a* and the fourth cable 43*b* of the impedance bond 4*c* are balanced.

As described using FIG. 7, when neither the first rail 2*a* nor the second rail 2*b* is broken, the return currents flowing through the first rail 2*a* and the second rail 2*b* are balanced, so that the current variations occurring in the first cable 41*a* and the second cable 41*b* of the impedance bond 4 are also balanced. The electromotive force generating unit 11 is configured such that it does not generate the electromotive force when the current variations of the same magnitude and direction occur in the first cable 41*a* and the second cable 41*b*. Therefore, when neither the first rail 2*a* nor the second rail 2*b* is broken, the electromotive force generating unit 11 does not generate the electromotive force.

On the other hand, as described using FIG. 8, when the first rail 2*a* or the second rail 2*b* is broken, imbalance occurs in the return currents flowing through the first rail 2*a* and the second rail 2*b* in the block section where the breakage occurs, so that the current variations occurring in the first cable 41*a* and the second cable 41*b* respectively connected to the first rail 2*a* and the second rail 2*b* in the block section where the breakage occurs are imbalanced. Since the electromotive force generating unit 11 generates the electromotive force in accordance with the current variations occurring in the first cable 41*a* and the second cable 41*b*, the rail breakage detection device 100 can detect the rail breakage.

The rail breakage detection device 100 detects the rail breakage when the current variations occurring in the first cable 41*a* and the second cable 41*b* are imbalanced. That is, in the case shown in FIG. 8, the rail breakage detection device 100 can detect that rail breakage occurs in the block section A2.

Further, when the first rail 2*a* or the second rail 2*b* is broken, the current variations occurring in the third cable 43*a* and the fourth cable 43*b* respectively connected to the first rail 2*a* and the second rail 2*b* in the block section where the rail breakage occurs are also imbalanced. Therefore, even in a case where a configuration in which the electromotive force generating unit 11 is attached to the third cable 43*a* and the fourth cable 43*b* is adopted, the rail breakage detection device 100 can detect rail breakage in the first rail 2*a* and the second rail 2*b* respectively connected to the third cable 43*a* and the fourth cable 43*b* when the current variations occurring in the third cable 43*a* and the fourth cable 43*b* are imbalanced.

Note that, also even in a configuration in which the electromotive force generating unit 11 is attached to the third cable 43*a* and the fourth cable 43*b*, the electromotive force generating unit 11 is configured not to generate the electromotive force when the current variations of the same magnitude and direction occur in the third cable 43*a* and the fourth cable 43*b*. Here, the current variations in the same direction means a case in which both the current flowing from the electrical neutral point P of the impedance bond 4 to the first rail 2*a* via the third cable 43*a* and the current flowing from the electrical neutral point P of the impedance bond 4 to the second rail 2*b* via the fourth cable 43*b* increase or decrease, or a case in which both the current flowing from the first rail 2*a* to the electrical neutral point P of the impedance bond 4 via the third cable 43*a* and the current flowing from the second rail 2*b* to the electrical neutral point P of the impedance bond 4 via the fourth cable 43*b* increase or decrease.

The rail breakage detection device according to Embodiment 1 comprises:

the electromotive force generating unit including the first core part that is provided annularly along the circumferential direction of the first cable electrically connecting the electrical neutral point of the impedance bond to a prescribed block section of the first rail, the impedance bond electrically connecting the first rail and the second rail in a pair, the second core part that is provided annularly along the circumferential direction of the second cable electrically connecting the electrical neutral point of the impedance bond to a prescribed block section of the second rail, the first coil that is wound around the first core part to generate the first electromotive force in accordance with a current variation occurring in the first cable, and the second coil that is connected electrically to the first coil, is wound around the second core part to generate the second electromotive force in accordance with a current variation occurring in the second cable, and generates the second electromotive force so as to cancel the first electromotive force out when the current variation occurring in the second cable is identical with the current variation occurring in the first cable in terms a direction and a magnitude, the electromotive force generating unit generating an electromotive force being a sum of the first electromotive force and the second electromotive force; and the breakage determination unit to determine that the first rail or the second rail is broken based on the electromotive force generated by the electromotive force generating unit.

Further, the breakage determination unit of the rail breakage detection device according to Embodiment 1 is characterized in that the rail breakage in the first rail or the second rail is determined when the electromotive force generated by the electromotive force generating unit is greater than or equal to the predetermined threshold.

With the above configuration, the rail breakage detection device 100 according to Embodiment 1 can detect the rail breakage with a simple configuration and reduce the maintenance load.

Further, the first core part and the second core part of the rail breakage detection device according to Embodiment 1 are characterized in that they are made of a magnetic material.

With the above configuration, in the rail breakage detection device 100 according to Embodiment 1, the positions where the first coil 112*a* and the second coil 112*b* are provided can be changed accordingly, and thus the configuration of the rail breakage detection device 100 can be simplified.

Further, the first core part and the second core part of the rail breakage detection device according to Embodiment 1 are characterized in that each part has a gap therein.

With the above configuration, in the rail breakage detection device 100 according to Embodiment 1, it is easy to attach the first core part 111*a* and the second core part 111*b* to the first cable 41*a* and the second cable 41*b*, respectively.

Further, the rail breakage detection device according to Embodiment 1 is characterized in that the direction of the normal vector of the opening plane formed in an inner side of the first core part and the direction of the current flowing through the first cable are parallel and the direction of the normal vector of the opening plane formed in an inner side of the second core part and the direction of the current flowing through the second cable are parallel.

With the above configuration, the rail breakage detection device 100 according to Embodiment 1 can accurately detect the current variations generated in the first cable 41*a* and the second cable 41*b*.

Embodiment 2

A configuration of a rail breakage detection device 200 according to Embodiment 2 of the present disclosure will be described. Note that description of the configurations which are the same as or corresponding to those of Embodiment 1 will be omitted, and only different portions of the configurations will be described. The rail breakage detection device 100 according to Embodiment 1 is configured to detect a case where imbalance occurs in the current variations of the return currents flowing through the first cable 41*a* and the second cable 41*b*, that is, a moment when a rail is broken. In contrast, in the rail breakage detection device 200 according to Embodiment 2, it is possible to detect a case where imbalance exists in the return currents flowing through the first cable 41*a* and the second cable 41*b*; that is, it can detect a state in which a rail is broken.

Figure 9:
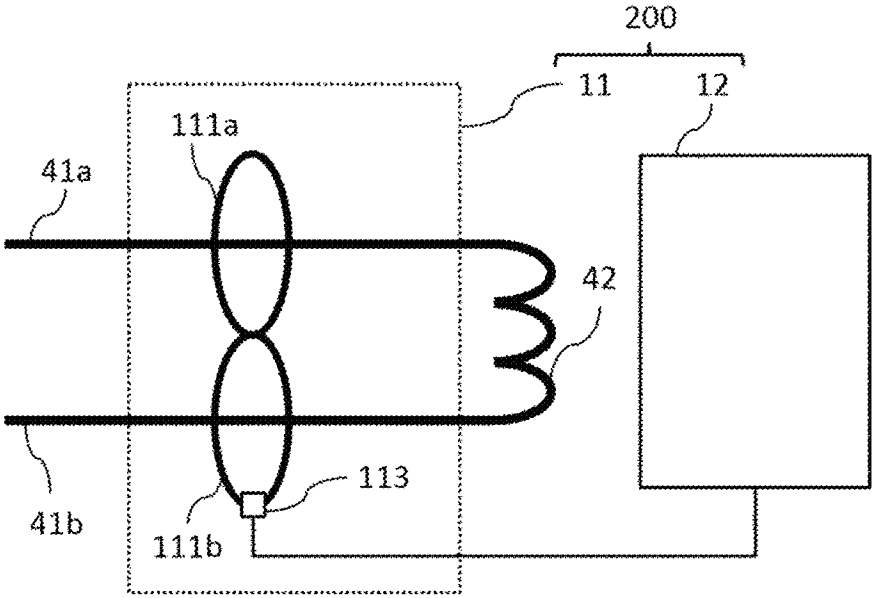
FIG. 9 is a diagram showing an example of a configuration of a rail breakage detection device according to Embodiment 2 of the present disclosure.

FIG. 9 shows an example of a configuration of the rail breakage detection device 200 according to Embodiment 2. As shown in FIG. 9, the rail breakage detection device 200 is configured to have a Hall element 113 instead of the first coil 112*a* and the second coil 112*b*. The Hall element 113 is an electromagnetic conversion element which utilizes the Hall effect.

The FIG. 9 shows a configuration in which the electromotive force generating unit 11 is attached to the first cable 41*a* and the second cable 41*b*. However, rail breakage can also be detected by using a configuration in which the electromotive force generating unit 11 is attached to the third cable 43*a* and the fourth cable 43*b*. In the following, the case in which the electromotive force generating unit 11 is attached to the first cable 41*a* and the second cable 41*b* will be described.

The first core part 111*a* and the second core part 111*b* are made of a magnetic material and generate a magnetic flux in accordance with the return currents flowing through the first cable 41*a* and the second cable 41*b*. The first core part 111*a* and the second core part 111*b* are mechanically connected.

In the first core part 111*a* and the second core part 111*b* according to Embodiment 2, when the return currents of the same magnitude and direction flow in the first cable 41*a* and the second cable 41*b*, a first magnetic flux generated in the first core part 111*a* and a second magnetic flux generated in the second core part 111*b* cancel each other out. That is, in the first core part 111*a* and the second core part 111*b*, when the return currents of the same magnitude and direction flow through the first cable 41*a* and the second cable 41*b*, no magnetic flux is generated, and when the return currents flowing through the first cable 41*a* and the second cable 41*b* are imbalanced, a magnetic flux is generated. The first core part 111*a* and the second core part 111*b* can be made, for example, by twisting an annular member at its intermediate position an odd number of times into an eight-character shape, the annular member being made of a magnetic material.

The Hall element 113 is placed in a gap provided in either the first core part 111*a* or the second core part 111*b*. The Hall element 113 is connected to the breakage determination unit 12. Further, the Hall element 113 is supplied with a constant current from the breakage determination unit 12.

The Hall element 113 generates an electromotive force in accordance with the magnetic flux generated by the first core part 111*a* and the second core part 111*b*. The breakage determination unit 12 measures the electromotive force generated by the Hall element 113. The breakage determination unit 12 determines the breakage when the electromotive force generated by the Hall element 113 is greater than or equal to a threshold. The threshold is determined, for example, by measuring in advance the values of the electromotive force generated by the Hall element 113 when the train 1 travels with the first rail 2*a* and the second rail 2*b* unbroken and by calculating an average and a standard deviation of the electromotive force. Specifically, the threshold is determined based on Equation (2).

The first core part 111*a* and the second core part 111*b* are configured such that a magnetic flux is generated when the return currents flowing through the first cable 41*a* and the second cable 41*b* are imbalanced. Therefore, the Hall element 113 generates an electromotive force when the return currents flowing through the first cable 41*a* and the second cable 41*b* are imbalanced.

That is, the Hall element 113 constantly generates an electromotive force while imbalance exists in the return currents flowing through the first cable 41*a* and the second cable 41*b*.

Therefore, the rail breakage detection device 200 according to Embodiment 2 can detect not only a moment when a rail is broken, but also a case where imbalance exists in the return currents flowing through the first cable 41*a* and the second cable 41*b*; that is, it can detect a state in which a rail is broken, and thereby the rail breakage can be detected more accurately.

Figure 10:
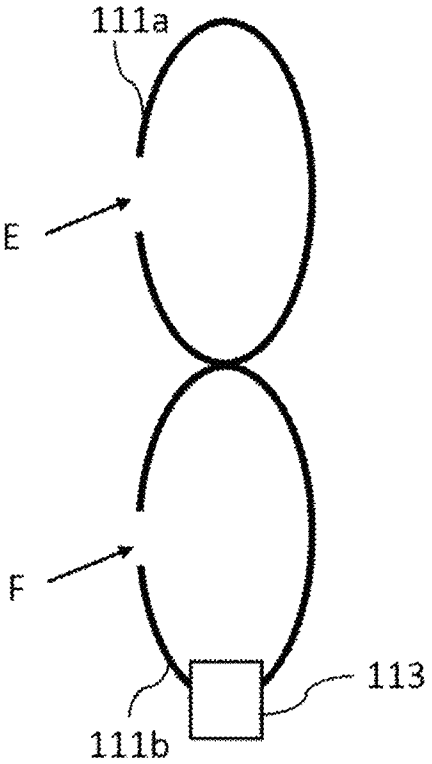
FIG. 10 is a diagram showing a variation of an electromotive force generating unit of the rail breakage detection device according to Embodiment 2 of the present disclosure.

FIG. 10 shows a variation of the electromotive force generating unit 11. The first core part 111*a* and the second coil 112*b* do not necessarily have a loop shape, and may have a structure having a gap E and a gap F, respectively, as shown in FIG. 10. By making the structure of the first core part 111*a* and the second coil 112*b* to have the gap E and the gap F, respectively, attachment of the first core part 111*a* and the second coil 112*b* to the first cable 41*a* and the second cable 41*b* becomes easy.

The rail breakage detection device according to Embodiment 2 comprises:

the electromotive force generating unit including the first core part that is provided annularly along the circumferential direction of the first cable electrically connecting the electrical neutral point of the impedance bond to a prescribed block section of the first rail, and made of a magnetic material to generate the first magnetic flux in accordance with the return current flowing through the first cable, the impedance bond electrically connecting the first rail and the second rail in a pair, the second core part that is provided annularly along the circumferential direction of the second cable electrically connecting the electrical neutral point of the impedance bond to a prescribed block section of the second rail, is mechanically connected to the first core part, generates the second magnetic flux in accordance with the return current flowing through the second cable, and is made of a magnetic material to generate the second magnetic flux so as to cancel the first magnetic flux out when the return current flowing through the second cable is identical with the return current flowing through the first cable in terms of a direction and a magnitude, and the Hall element that is disposed in the gap provided in either the first core part or the second core part to generate the electromotive force in accordance with a sum of the first magnetic flux and the second magnetic flux; and the breakage determination unit that determines that the first rail or the second rail is broken based on the electromotive force generated by the Hall element of the electromotive force generating unit.

With the above configuration, the rail breakage detection device 200 according to Embodiment 2 can detect the case where imbalance exists in the return currents flowing through the first cable 41*a* and the second cable 41*b*; that is, it can detect the state in which a rail is broken, and thereby rail breakage can be detected more accurately.

Embodiment 3

Figure 11:
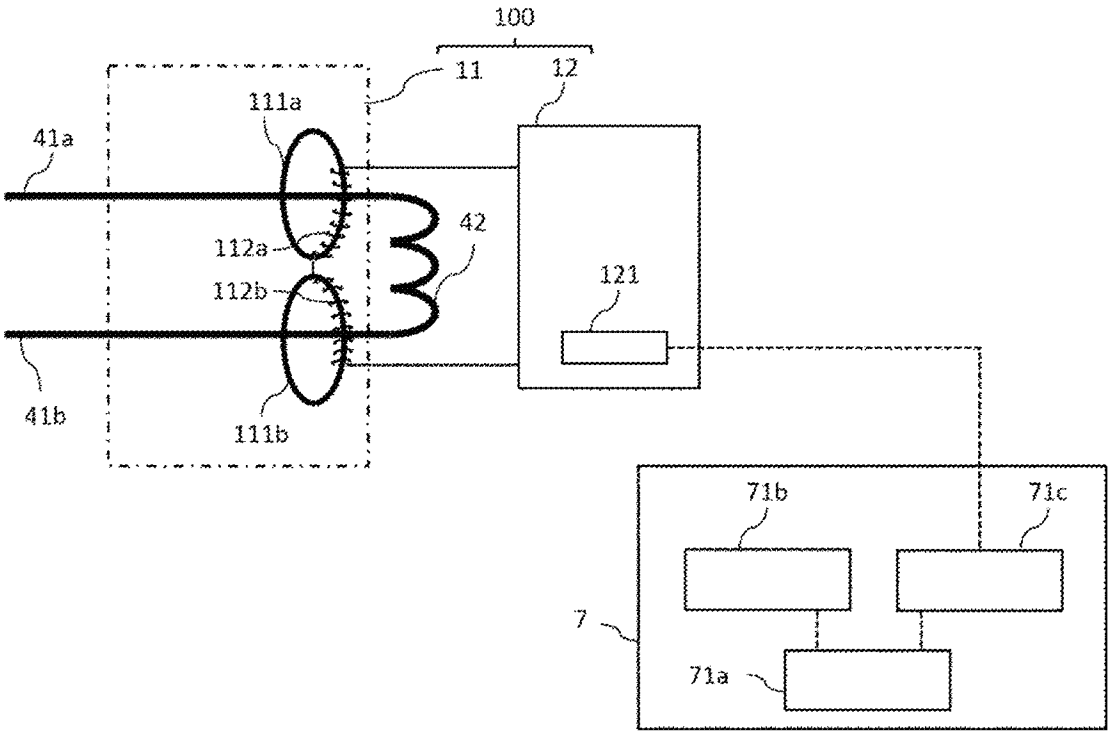
FIG. 11 is a diagram showing an example of a configuration of a rail breakage result management system according to Embodiment 3 of the present disclosure.

Next, a rail breakage result management system which manages breakage detection results of rails using the rail breakage detection device according to Embodiment 1 or Embodiment 2 will be described. FIG. 11 is a diagram showing an example of a configuration of the rail breakage result management system according to Embodiment 3 which manages the breakage detection results of the rails using the rail breakage detection device according to Embodiment 1 or Embodiment 2. As shown in FIG. 11, the rail breakage result management system includes the rail breakage detection device 100 and a management server 7.

The breakage determination unit 12 of the rail breakage detection device 100 includes an information output unit 121. The information output unit 121 is connected to the management server 7 via a network. The network is, for example, a local area network (LAN), a wide area network (WAN), a bus, or a private line. If the breakage detection results of the rails and management numbers of the block sections can be outputted to the management server 7, the information output unit 121 does not need to be included in the breakage determination unit 12, and communication equipment or the like separated from the breakage determination unit 12 may be used.

The breakage determination unit 12 stores the management numbers of the block sections in advance. The breakage detection results of the rails and the management numbers of the block sections are outputted to the management server 7 from the information output unit 121 via the network. The management numbers of the block sections are the numbers assigned to each of the block sections of the rails, and each are the number for specifying a position of a block section.

The management server 7, which is a server apparatus operated by a railway management business operator, etc., receives the breakage detection results of the rails outputted from the information output unit 121 and the management numbers of the block sections via the network and stores the breakage detection results of the rails and the management numbers of the block sections in association with each other.

The management server 7 includes a control unit 71*a* which controls the entire operation of the management server 7, an information storage unit 71*b* which stores information etc., received via the network, and a communication unit 71*c* which sends and receives information via the network.

The information storage unit 71*b* stores the breakage detection results of the rails and the management numbers of the block sections that are received from the information output unit 121 via the network, in association with each other.

Figure 12:
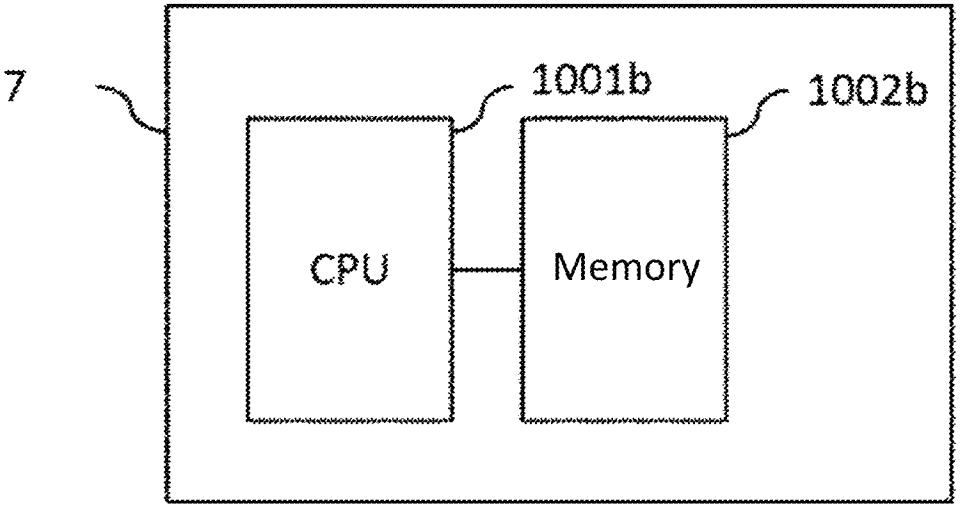
FIG. 12 is a diagram showing an example of a configuration of a management server of the rail breakage result management system according to Embodiment 3 of the present disclosure.

FIG. 12 is a diagram showing a configuration of the management server 7. The management server 7 can be implemented by software control by a CPU 1001*b* executing a program stored in a memory 1002*b*, as shown in FIG. 12.

Figure 13:
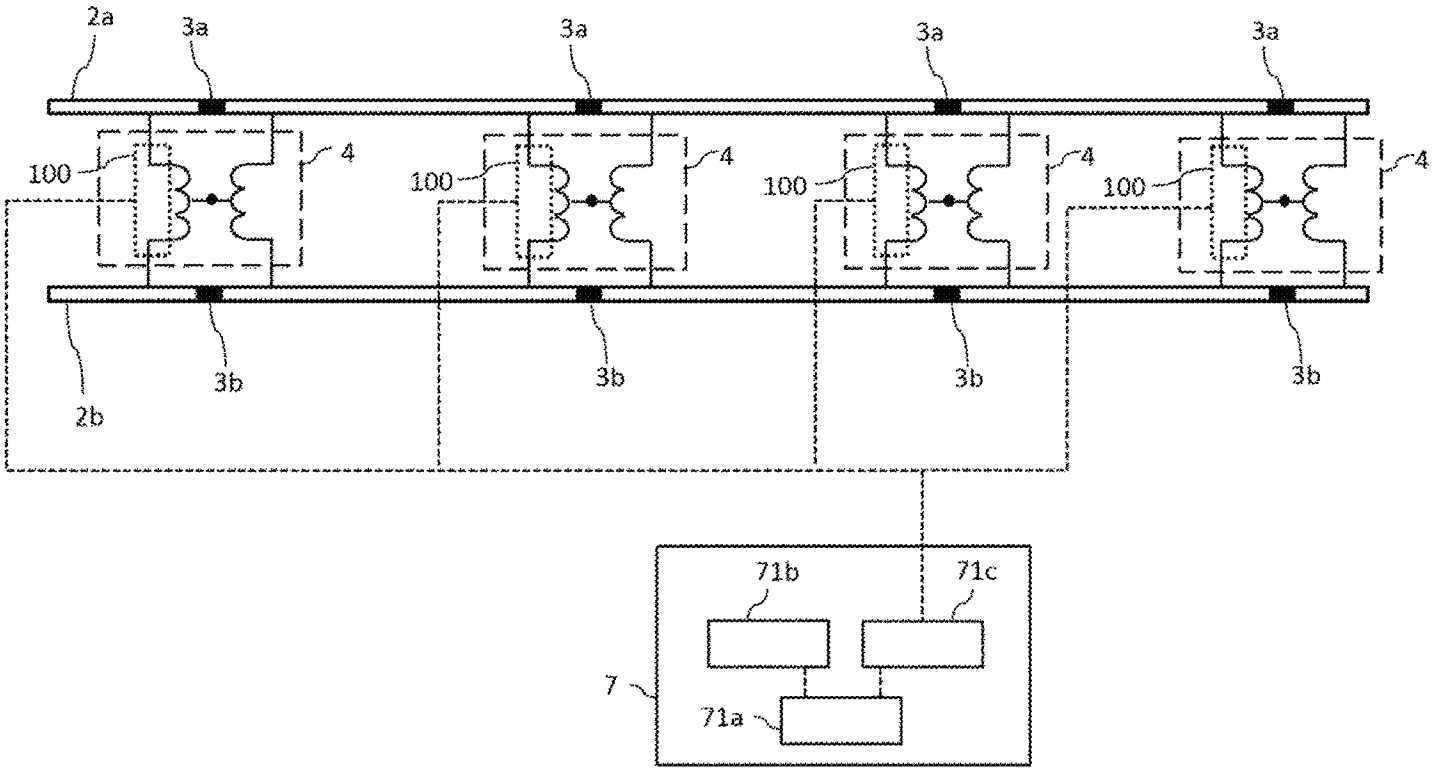
FIG. 13 is a diagram showing an example of a configuration of the rail breakage result management system according to Embodiment 3 of the present disclosure.

FIG. 13 is a diagram showing an example of a configuration of the rail breakage result management system in which the rail breakage detection device 100 is provided in each of the block sections of the rails. The rail breakage detection device 100 installed to the impedance bond 4 individually provided in each block section outputs the breakage detection results of the rails and the management number of the block section to the management server 7 via the network. The management server 7 manages the detection results for each block section. Since an identification number is assigned to each block section, the rail breakage result management system can manage appropriately in which block section the breakage occurs.

The rail breakage result management system according to Embodiment 3 includes:

the rail breakage detection device according to Embodiment 1 or 2; and the management server to store the breakage detection result of the rails detected by the rail breakage detection device and the management number in association with each other, the management number being assigned individually to a block section of rails, wherein the rail breakage detection device comprises the information output unit to output the breakage detection result of the rails and the management number to the management server via the network.

With the above configuration, the rail breakage result management system according to Embodiment 3 can appropriately manage the block section in which the breakage occurs.

Within the scope of the invention, some of the embodiments disclosed here can be freely combined, and each of the embodiments can be accordingly modified or omitted.

DESCRIPTION OF SYMBOLS

100, 200 rail breakage detection device,
1 train,
2*a* first rail,
2*b* second rail,
3*a*, 3*b* rail insulating member,
4 impedance bond,
5 substation,
6 overhead line,
7 management server,
11 electromotive force generating unit,
12 breakage determination unit,
41*a* first cable,
41*b* second cable,
42*a* first winding,
42*b* second winding,
43*a* third cable,
43*b* fourth cable,
44 fifth cable,
71*a* control unit,
71*b* information storage unit,
71*c* communication unit,
111*a* first core part,
111*b* second core part,
112*a* first coil,
112*b* second coil,
113 Hall element,
121 information output unit,
1001*a*, 1001*b* CPU,
1002*a*, 1002*b* memory

The invention claimed is:

1. A rail breakage detection device comprising:

a first core part that is provided annularly along a circumferential direction of a first cable electrically connecting an electrical neutral point of an impedance bond to a prescribed block section of a first rail, the impedance bond electrically connecting the first rail and a second rail in a pair, a second core part that is provided annularly along a circumferential direction of a second cable electrically connecting the electrical neutral point of the impedance bond to the prescribed block section of the second rail, a first coil that is wound around the first core part to generate a first electromotive force in accordance with a current variation occurring in the first cable, and a second coil that is connected electrically to the first coil, is wound around the second core part to generate a second electromotive force in accordance with a current variation occurring in the second cable, and generates the second electromotive force so as to cancel the first electromotive force out when the current variation occurring in the second cable is identical with the current variation occurring in the first cable in terms of a direction and a magnitude; and a CPU configured to determine that the first rail or the second rail is broken based on an electromotive force being a sum of the first electromotive force and the second electromotive force.

2. The rail breakage detection device according to claim 1, wherein the first core part and the second core part are made of a magnetic material.

3. The rail breakage detection device according to claim 1, wherein the CPU determines that the first rail or the second rail is broken when the electromotive force being a sum of the first electromotive force and the second electromotive force is greater than or equal to a predetermined threshold.

4. The rail breakage detection device according to claim 1, wherein the first core part and the second core part each have a gap therein.

5. The rail breakage detection device according to claim 1, wherein a direction of a normal vector of an opening plane formed in an inner side of the first core part and a direction of current flowing through the first cable are parallel, and a direction of a normal vector of an opening plane formed in an inner side of the second core part and a direction of current flowing through the second cable are parallel.

6. A rail breakage result management system comprising:

the rail breakage detection device according to claim 1; and a management server to store a breakage detection result of rails detected by the rail breakage detection device and a management number in association with each other, the management number being assigned individually to a block section of the rails, wherein the rail breakage detection device comprises an information output unit to output the breakage detection result of the rails and the management number to the management server via a network.

7. A rail breakage detection device comprising:

a first core part that is provided annularly along a circumferential direction of a first cable electrically connecting an electrical neutral point of an impedance bond to a prescribed block section of a first rail, and is made of a magnetic material to generate a first magnetic flux in accordance with return current flowing through the first cable, the impedance bond electrically connecting the first rail and a second rail in a pair, a second core part that is provided annularly along a circumferential direction of a second cable electrically connecting the electrical neutral point of the impedance bond to the prescribed block section of the second rail, is mechanically connected to the first core part, generates a second magnetic flux in accordance with return current flowing through the second cable, and is made of a magnetic material to generate the second magnetic flux so as to cancel the first magnetic flux out when the return current flowing through the second cable is identical with the return current flowing through the first cable in terms of a direction and a magnitude, and a Hall element that is disposed in a gap provided in either the first core part or the second core part to generate an electromotive force in accordance with a sum of the first magnetic flux and the second magnetic flux; and a CPU configured to determine that the first rail or the second rail is broken based on the electromotive force generated by the Hall element.

8. The rail breakage detection device according to claim 7, wherein the CPU determines that the first rail or the second rail is broken when the electromotive force generated by the Hall element is greater than or equal to a predetermined threshold.

9. The rail breakage detection device according to claim 7, wherein the first core part and the second core part each have a gap therein.

10. The rail breakage detection device according to claim 7, wherein a direction of a normal vector of an opening plane formed in an inner side of the first core part and a direction of current flowing through the first cable are parallel, and a direction of a normal vector of an opening plane formed in an inner side of the second core part and a direction of current flowing through the second cable are parallel.

* * * * *